US012808642B2

(12) United States Patent
Kruger et al.

(10) Patent No.: US 12,808,642 B2
(45) Date of Patent: Nov. 24, 2026

(54) MONITORING DEVICE

(71) Applicant: DETNET SOUTH AFRICA (PTY) LTD, Johannesburg (ZA)

(72) Inventors: Michiel Jacobus Kruger, Johannesburg (ZA); Marinus Yates, Benoni (ZA); Cory Lo, Simsbury, CT (US)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 18/845,492

(22) PCT Filed: Nov. 30, 2022

(86) PCT No.: PCT/ZA2022/050062

§ 371 (c)(1),
(2) Date: Sep. 10, 2024

(87) PCT Pub. No.: WO2023/173145

PCT Pub. Date: Sep. 14, 2023

(65) Prior Publication Data

US 2025/0207900 A1 Jun. 26, 2025

(30) Foreign Application Priority Data

Mar. 10, 2022 (ZA) ..... 2022/02886

(51) Int. Cl.

| | |
|---|---|
| ***F42D 1/055*** | (2006.01) |
| ***E21B 43/1185*** | (2006.01) |
| ***E21B 47/06*** | (2012.01) |
| ***F42B 3/00*** | (2006.01) |
| ***F42D 3/04*** | (2006.01) |

(52) U.S. Cl.
CPC ..... *F42D 1/055* (2013.01); *E21B 43/1185* (2013.01); *E21B 47/06* (2013.01); *F42D 3/04* (2013.01); *F42B 3/00* (2013.01)

(58) Field of Classification Search
CPC ... F42D 1/05; F42D 1/055; F42D 3/04; F42D 1/00; F42D 1/04; F42D 1/045; F42D 3/00; F42D 3/06; E21B 43/1185; E21B 43/11857; E21B 47/06; E21B 47/07; F42B 3/00; F42B 3/10
USPC ..... 102/301, 217
See application file for complete search history.

(56) References Cited

U.S. PATENT DOCUMENTS

| | | | | |
|---|---|---|---|---|
| 10,267,611 | B2 * | 4/2019 | Lownds | F42D 5/00 |
| 10,563,967 | B2 * | 2/2020 | Muller | F42D 1/05 |
| 12,044,516 | B2 * | 7/2024 | Teowee | E21B 43/1185 |
| 12,529,550 | B2 * | 1/2026 | Teowee | E21B 43/1185 |
| 2019/0049226 | A1 | 2/2019 | Liebenberg et al. | |

(Continued)

FOREIGN PATENT DOCUMENTS

WO 2021/263110 A1 12/2021

OTHER PUBLICATIONS

International Search Report of PCT/ZA2022/050062 dated Mar. 2, 2023.

*Primary Examiner* — James S Bergin
(74) *Attorney, Agent, or Firm* — MATTINGLY & MALUR, PC

(57) ABSTRACT

A monitoring arrangement in a detonator system which uses one or more sensors to detect various conditions at a blast site, and transmitters which transmit data on the detected conditions to a control center.

9 Claims, 1 Drawing Sheet

(56) References Cited

U.S. PATENT DOCUMENTS

2023/0266109 A1* 8/2023 Teowee ..... F42D 1/05
102/202.5

* cited by examiner

MONITORING DEVICE

BACKGROUND OF THE INVENTION

This invention relates to a monitoring device for use in a blasting system.

Mine productivity is paramount to a profitable mining business. To the extent that blasting processes impact on mine productivity it is important to be able to analyse data relating to or arising from a blasting process. To achieve this goal some type of data collection technique should be used.

Various factors can influence a blasting process but the degree to which this happens is not always easily ascertainable. For example a blasting process can be affected by environmental temperature and humidity levels, and an explosive which is placed in a so-called "hot hole" would not necessarily function optimally.

In a general sense it can be said that it is important to be able to gather data of various kinds pertaining to factors which prevail before and, where possible, during and after, a blasting process.

It is an object of the present invention to address, at least to some extent, this requirement.

SUMMARY OF THE INVENTION

The invention provides a monitoring device for use in a blasting system which includes a plurality of detonators which are positioned in respective boreholes which contain explosive material and a blast controller for controlling initiation of the detonators via a wire bus connection to the detonators, the monitoring device comprising a housing, a processor which is mounted to the housing, at least one sensor mounted to or linked to the housing, wherein the sensor, in use, produces data in response to detection of a chosen condition and transmits said data to the processor, a first communication interface whereby the processor outputs a signal, which contains at least said data, via the wire bus in the blasting system, and a power source for powering the processor and the sensor.

The housing may be made in any suitable form or shape and preferably is made to withstand arduous conditions which pertain at a typical blast site. The housing may be designed to be reused and in this event, typically, the monitoring device would be positioned at a blast site so that it is not exposed to adverse effects of blasting. Alternatively the housing may be designed so that it is of little consequence if the housing is consumed or destroyed during a blasting process. This possibility may for example arise if the monitoring device is placed close to a detonator or is associated with or forms a part of a booster.

The function of the processor is to control the operation of the monitoring device. Data from the sensor, conveyed to the processor, is stored and processed and, as appropriate, communicated via the wire bus as a data signal to the blast controller or to some other data collection component as may be required.

The monitoring device may include a second communication interface to enable communication between the device and external equipment, e.g. a tagger or the like, to be effected. This makes it possible for an operator at a blast site to interrogate the monitoring device and to exchange data between the tagger and the processor e.g. to transfer information to the processor or to obtain information from the processor.

The power source may comprise a battery or a capacitor which may be rechargeable using, for example a solar energy harvesting unit such as a solar cell which is used to transfer energy into the power source thereby to provide energy for the operation of the active components in the monitoring device. The use of solar energy is dependent on installation and use conditions.

The monitoring device can be positioned at a location at which it is not exposed to adverse effects produced by blasting. For example the monitoring device may be connected to the wire bus at a location which is displaced from a borehole by a suitable distance. In another configuration the monitoring device is designed to be used together with a detonator, a booster or other blasting assembly.

The monitoring device, typically, would be connected to a line in a wire bus, or to a branch line leading from a surface line (trunk line) to a detonator etc.

The monitoring device may be placed in a borehole so that it is exposed to the explosive material which is charged into the borehole. In this application the sensor, suitably configured, may be used to detect the presence of the explosive material and optionally, to identify the nature of the explosive material.

The monitoring device can be used with a plurality of sensors which are respectively responsive to various conditions. Each sensor is connected to the processor and provides a respective signal to the processor. Conditions which may be monitored in this way include (without limitation) temperature at a blast site, humidity and water levels, pressure, the occurrence of lightning or rain, prevailing noise levels, and voltages, which may exist for diverse reasons, in the vicinity of the monitoring device e.g. due to static electricity effects or as a result of inductance by current-carrying cables, and so on.

A primary function of the monitoring device is to collect data on variable factors at or near a blast site so that, through the subsequent processing or assessment of that data, the effect or effects of such factors on a blasting process can be identified and, where necessary, addressed in later blasting processes. The outcome of a blasting process can, in accordance with known techniques or expected results be predicted with a reasonable degree of certainty and deviations from the predicted outcome can then be linked to or associated with the conditions which may have been detected and monitored at all relevant times up to blasting taking place.

BRIEF DESCRIPTION OF THE DRAWINGS

The invention is further described by way of example with reference to the accompanying drawings in which.

DESCRIPTION OF PREFERRED EMBODIMENT

Figure 1:
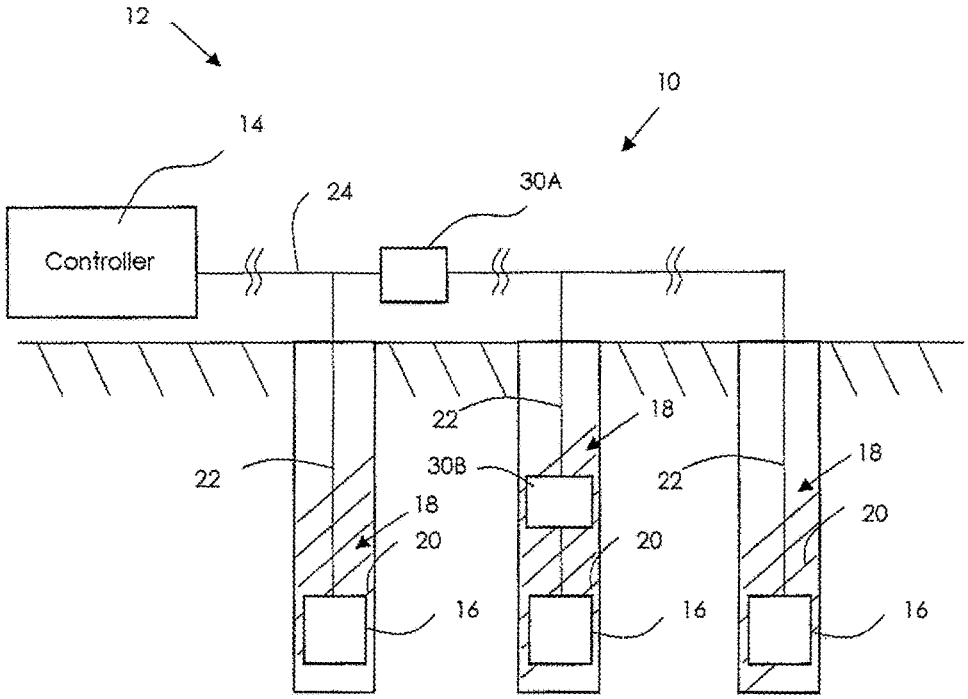
FIG. 1 depicts a blasting system in which one or more monitoring devices according to the invention are employed.

FIG. 1 of the accompanying drawings illustrates a blasting system 10 which is established at a blast site 12.

The blasting system 10 includes a blasting controller 14 and a plurality of detonators 16 which are positioned using conventional techniques, not further described herein, in respective boreholes 18. Explosive material 20 is charged into each borehole. "Detonator" as used herein includes a detonator, and a detonator assembly.

Each detonator 16 is connected via a respective branch line 22 to a wire bus or trunk line 24, of a blasting harness, on surface.

The blasting system 10 includes one or more monitoring devices 30 each of which is according to the invention. In FIG. 1 a monitoring device 30A is shown connected to the surface line 24. A second monitoring device 30B is positioned in a borehole 18 and is connected to or in line with the corresponding branch line 22. The monitoring device 30B, in use, is covered in explosive material 20. The number of devices 30, and the manner of use of each device, can readily be decided by a technician on site, taking into account prevailing circumstances and objectives. Each device is then connected directly or indirectly to the surface line 24 or to a chosen branch line 22.

Figure 2:
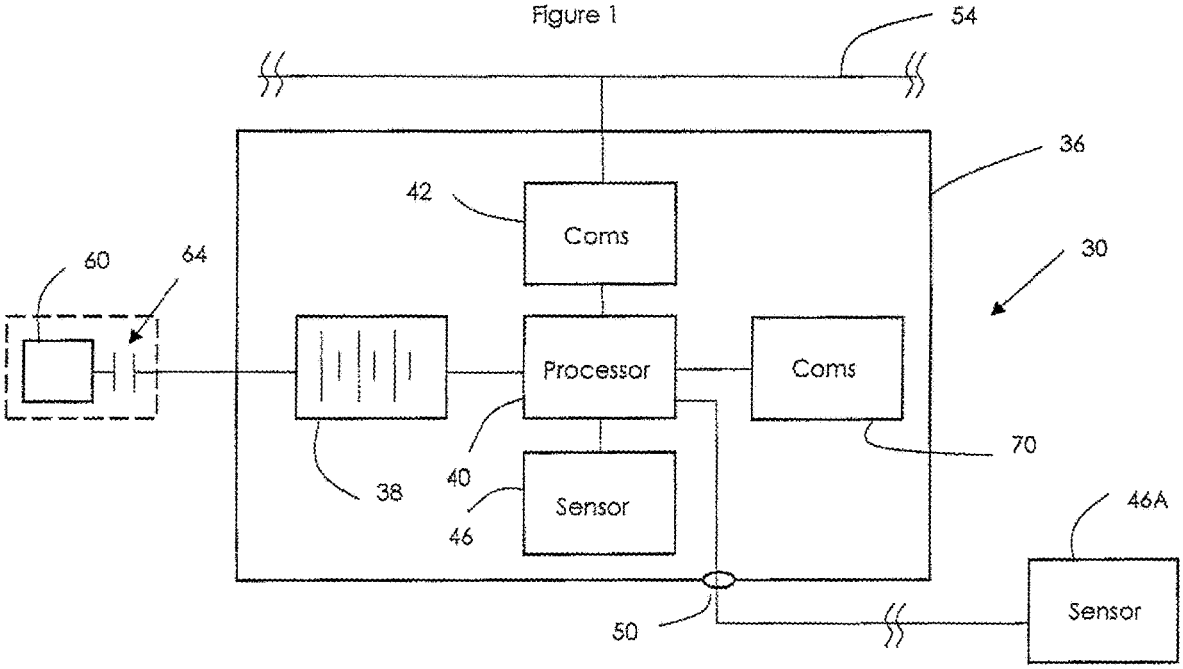
FIG. 2 is a block diagram representation of a monitoring device according to the invention.

FIG. 2 is a schematic representation of the monitoring device 30.

The monitoring device 30 includes a housing 36 of any suitable shape or form which is designed to withstand the rigours of installation and use at a blast site. Mounted inside the housing is a battery power source 38, a processor 40, a first communication interface 42 and at least one sensor 46. The processor 40 includes, in a memory, an identifier which uniquely identifies the monitoring device. A GPS or similar location identifying mechanism may be contained in the housing 36. The operation of the processor in this regard is such that when a signal is sent from the device the origin and location of the device are known. Also that signal would reflect the time and date of any measurement by the sensor and the time and date of transmission of the signal.

The sensor 46 is shown mounted inside the housing 36. Due care is taken of the nature of the sensor and it is mounted in such a way that, in use, it is responsive to an identified operating condition e.g. a humidity or temperature level at the housing, to detect a pressure in a component, or the like. The monitoring device can include a plurality of sensors each of which is selected to perform a different sensing function. Each sensor outputs data, dependent on the condition sensed, to the processor 40.

Another possibility is to link a sensor, designated 46A in FIG. 2, to the processor 40 through a suitable port 50 in the housing. This approach enables the housing to be positioned at one location and one or more sensors to be mounted at different locations which are, possibly, remote from one another and also from the housing. One or more sensors, not shown, could also be fixed in a secure manner to an outer surface of the housing.

The first communication interface 42 is connected to a bus line 54. The bus line 54 may comprise the trunk or bus line 24 shown in FIG. 1 if the monitoring device is the device marked 30A. If the monitoring device is the device marked 30B in FIG. 1 then the line 54 may comprise the branch line 22. Other types of connections are however possible.

Depending on installation conditions the monitoring device can draw power from a solar cell 60 which is exposed to solar radiation and energy from the cell, suitably processed, can be used to charge the battery 38. Another possibility is that the solar cell can be used to charge a capacitor 64 which is used in addition to or in place of the battery 38 to power the monitoring device.

The monitoring device 30 is connected to the wire bus at a convenient location. Through the first communication interface 42, data from the monitoring device 30 is sent to the controller 14, or to some other chosen location, as required. This data communication takes place via the wire bus. It is also possible for the controller 14, or another source (not shown), to send data or control signals to the monitoring device 30, for example to test the working of the device, to turn the device on and off so as to save battery energy, and so on. Such functions are implemented by the processor upon receipt of an appropriate control signal.

The sensors 46 etc. which are included in the monitoring device enable data on a range of variable factors and parameters to be captured and to be logged by the processor 40. That data is communicated to the controller 14 as required. For example the processor 40 may at pre-programmed intervals automatically cause data signals to be sent to the controller. Alternatively data signals are sent upon receipt by the interface 42 and the processor 40 of an interrogating signal from the controller 14. Parameters which can be measured by the sensors include, without limitation, voltage, temperature, pressure, moisture, humidity levels and so on.

The device 30B which is close to the explosive 20 in a borehole is designed to be responsive to the presence, and to the composition, of the explosive 20. In this regard the explosive 20 which is pumped into a borehole can include, if required, an additive, such as a specially formulated chemical, which uniquely identifies the explosive and which contains information relating to the composition of the explosive, and the date of its manufacture. Thus information on characteristics of the explosive which play an important role in the effectiveness or efficiency of a blast can be determined by the monitoring device. Such characteristics include, without limitation, the composition of the explosive material, its density and humidity (moisture) level, and the date of manufacture of the explosive material. Relevant parameters are detected by one or more sensors and relayed to the blasting controller 14 or some other machine as necessary.

A second communication interface 70, which is optional, is provided to enable an operator using a mobile device such as a tagger (not shown) to interrogate the monitoring device 30 and to transmit data to the processor, and to extract data which may have been collected by the monitoring device. This is in addition to, or in place of, transmitting such data to the blasting controller 14.

The second communication interface 70 may also have a communication capability which can be utilized independently of any interrogating signal on the surface line 24. For example referring to the monitoring device 30B which is embedded in the explosive material 20, the associated detonator 16 may have an RFID or a near field communication (NFC) capability. Data on the detonator 16 collected, say, from a memory or sensor within the detonator and related to any operational aspect of the detonator such as power level, timing accuracy and delay time etc., can be transferred using the RFID or NFC capability to the monitoring device 30B and then relayed by the first or the second communication interface (42, 70) through the lines 22 and 24 to the blast controller or to some other device which could be linked, as appropriate, to the wire bus 24, using the aforementioned signal transmission technique.

It is also possible to associate a monitoring device 30 directly with a detonator or detonator assembly e.g. 'by mounting the housing 36 to, or incorporating the housing into, structure of the detonator or detonator assembly.

The invention claimed is:

1. A blasting system which includes a plurality of detonators which are positioned in respective boreholes which contain explosive material, a blast controller for controlling initiation of the detonators via a wire bus, a monitoring device which is connected directly to a wire bus, where the monitoring device comprises a housing, a processor which is mounted to the housing, at least one sensor mounted to or linked to the housing, wherein the sensor in use produces data in response to detection of a chosen condition and transmits said data to the processor, a first communication interface whereby the processor outputs a signal, which contains at least said data, via the wire bus to the controller, and a power source for powering the processor and the sensor, wherein the monitoring device is positioned at a location which is displaced from the detonators so that the monitoring device which is reusable is not exposed to adverse effects of blasting.

2. The blasting system of claim 1 wherein the monitoring device includes a second communication interface which is configured to effect data exchange between the processor and an external tagger, or between the processor and a detonator.

3. The blasting system of claim 2 wherein the second communication interface is configured to receive data from a detonator in the blasting system and wherein said data is then relayed by the first communication interface or the second communication interface via the wire bus to the blast controller.

4. The blasting system of claim 1 wherein the power source in the monitoring device comprises at least one of the following: a battery and a capacitor.

5. The blasting system of claim 1 wherein said chosen condition is selected from temperature, moisture, humidity, lightning, rain, noise, pressure, voltage.

6. The blasting system of claim 1 wherein the monitoring device includes an identifier which uniquely identifies the monitoring device.

7. The blasting system of claim 1 wherein the monitoring device includes a location identifying mechanism which provides data on the geographical position of the monitoring device.

8. The blasting system of claim 1 wherein the data in said signal output by the processor includes data selected from the time and date of detonation and the time and date of the output of the signal.

9. The blasting system of claim 1 wherein the blast controller is configured to assess data on variable factors at the blast site which is collected by the monitoring device thereby to identify the effect of such factors on a blasting process.

* * * * *